US007168285B2

(12) United States Patent
Sakanoue et al.

(10) Patent No.: US 7,168,285 B2
(45) Date of Patent: Jan. 30, 2007

(54) DOOR DEVICE FOR VENDING MACHINE

(75) Inventors: Kenji Sakanoue, Saitama-ken (JP); Koji Hachii, Saitama-ken (JP); Toshiyuki Horiguchi, Gunma-ken (JP); Takeshi Sasaki, Saitama-ken (JP)

(73) Assignee: Fuji Electric Co., Ltd., Kanagawa (JP)

( * ) Notice: Subject to any disclaimer, the term of this patent is extended or adjusted under 35 U.S.C. 154(b) by 0 days.

(21) Appl. No.: 11/033,655

(22) Filed: Jan. 13, 2005

(65) Prior Publication Data

US 2005/0120540 A1 Jun. 9, 2005

Related U.S. Application Data

(63) Continuation of application No. 09/918,569, filed on Aug. 1, 2001, now Pat. No. 6,890,044.

(30) Foreign Application Priority Data

Sep. 20, 2000 (JP) ..... 2000-285204

(51) Int. Cl.
*B21D 31/00* (2006.01)
*E06B 5/00* (2006.01)

(52) U.S. Cl. ..... 72/372; 72/379.2; 72/362; 312/321.5; 52/784.1

(58) Field of Classification Search ..... 72/362, 72/379.2, 372, 374, 375; 312/321.5, 116; 52/784.1

See application file for complete search history.

(56) References Cited

U.S. PATENT DOCUMENTS

| | | | | |
|---|---|---|---|---|
| 2,130,617 | A | 9/1938 | Dockham | |
| 2,131,680 | A | 9/1938 | Zahodiakin | |
| 2,408,704 | A | 10/1946 | Taylor | |
| 2,686,703 | A | 8/1954 | Nave et al. | |
| 2,740,266 | A | 4/1956 | Kesling | |
| 2,741,100 | A | 4/1956 | Young | |
| 2,813,767 | A | 11/1957 | Berg et al. | |
| 2,903,315 | A | 9/1959 | Schory et al. | |
| 5,174,146 | A * | 12/1992 | Heurteboust et al. | 72/348 |
| 5,943,899 | A * | 8/1999 | Jung | 72/379.2 |

FOREIGN PATENT DOCUMENTS

JP 2001116431 A * 4/2001

* cited by examiner

*Primary Examiner*—Jermie E. Cozart
(74) *Attorney, Agent, or Firm*—Foley & Lardner LLP

(57) ABSTRACT

A single sheet of a metal member is pressed to form an integrally molded structure of a front, a side, and a top of a door body without any joint. In addition, the front of the door body and a concave for displaying sample products or the like are integrally produced by molding. By virtue of this constitution, a door device for a vending machine can be realized which can be easily produced and possesses excellent appearance and strength.

5 Claims, 7 Drawing Sheets

FIG. 5C
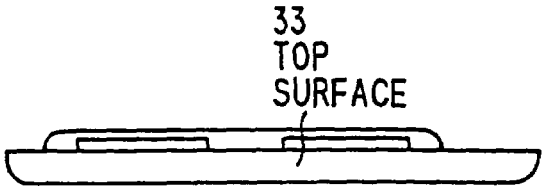
FIG. 5B
FIG. 5A
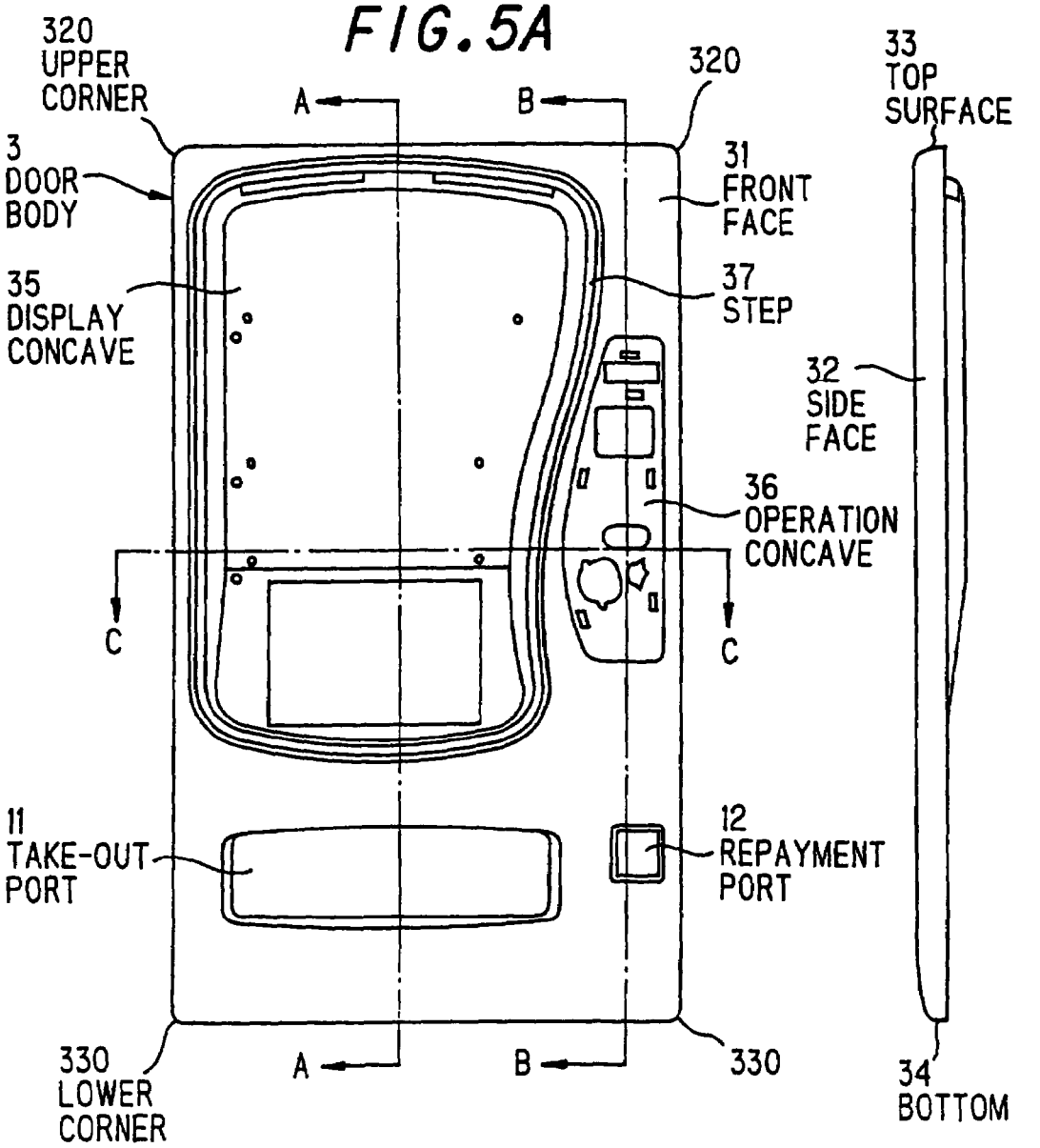

DOOR DEVICE FOR VENDING MACHINE

This application is a continuation of Ser. No. 09/918,569 filed Aug. 1, 2001 now U.S. Pat. No. 6,890,044.

FIELD OF THE INVENTION

The invention relates to a door device for opening/closing the front of a vending machine body.

BACKGROUND OF THE INVENTION

FIG. 1 shows a conventional door body 100 of a vending machine. As shown in FIG. 1, the conventional door body 100 has a front 110, a side 120, and a top 130. The front 110 is provided with, for example, a display opening 111 for disposing therein a sample product display chamber (not shown) and a service opening 112 for disposing therein, for example, a money slot and a money amount indicator (not shown). Various functional parts are mounted on this door body 100 to constitute a door device for a vending machine.

The above-described conventional door body 100 is produced by molding as follows. A flat sheet metal member is provided. Openings, such as a display opening 111 and a service opening 112, are cut out, and the periphery of the member is then cut to a predetermined shape. The side 120 and the top 130 each are formed by bending by means of a bender. Next, the side 120 is connected by welding to the top 130 at a joint 140. Thereafter, the welded portion is polished for flattening. Finally, the welded portion is coated with a rust preventive to form a door body 100.

A separately assembled display chamber and the like are mounted on the molded door body 100 to produce a door device.

In the molding of the conventional door body 100, however, the step of bending, the step of welding, and the step of finishing are necessary. That is, the necessary number of steps is large, and, thus, this requires a lot of time and causes a high cost in the molding. Further, although the welded portion is finished, finishing to a fully smooth extent is difficult. In this case, the welded portion having surface irregularities sometimes spoils the appearance of the door body. Further, the welded portion has poor corrosion resistance, and this necessitates, for example, rust preventing treatment after the finishing.

Further, since a large opening for assembling a display chamber and the like to the door body is provided, it is difficult to ensure the strength of the door device. In addition, since the display chamber and the like are separately assembled and mounted, the necessary number of steps for the production of the door body are large.

SUMMARY OF THE INVENTION

Accordingly, it is an object of the invention to provide a door device for a vending machine which can be easily produced and has superior appearance and strength.

According to the first feature of the invention, there is provided a door device for opening/closing the front of a vending machine body, said door device comprising an integrally molded structure of a front, a side, and a top of a door body, without any joint, produced by pressing of a single sheet of a metal member.

According to this construction, the front, the side, and the top of the door body are integrally molded by pressing without any joint. Therefore, unlike the prior art technique, welding for connecting the faces to each other is unnecessary. For this reason, the work is easy, and a door body possessing superior appearance and corrosion resistance can be produced.

In the door device according to the first feature of the invention, preferably, a portion for connecting the front to the side, a portion for connecting the side to the top, and a portion for connecting the front to the top have a curved surface, while a portion for connecting three faces of the front, the side, and the top to one another has a spherical surface.

According to this construction, since the portion for connecting the front to the side, the portion for connecting the front to the top, and the portion for connecting the side to the top of the door body have a curved surface or a spherical surface. This can avoid local concentration of and can disperse the expansion and the contraction of the sheet member at the time of pressing and thus can prevent a local reduction in wall thickness of the door body or cockling.

Further, in the door device described just above according to the first feature of the invention, preferably, the curved surface of the portion for connecting the top to the side has been molded so that the radius of curvature is reduced toward the rear.

According to this construction, since the radius of curvature in the forward direction is large, the expansion and the contraction of the sheet member at the time of pressing can be dispersed. At the same time, since the radius of curvature in the backward direction is small, even though the vending machine body in its corner portion, which, when the door device has been closed, faces the door device, is not formed at a large radius of curvature, there is no sense of incongruity in appearance.

In the above door devices according to the first feature of the invention, preferably, the bottom, the front, and the side of the door body have been integrally molded without any joint.

According to this construction, the bottom also is integrally formed without any joint. This better facilitates the production of the door device and, in addition, can improve the appearance and the corrosion resistance.

In the door device described just above according to the invention, preferably, a portion for connecting the front to the side, a portion for connecting the side to the bottom, and a portion for connecting the front to the bottom have a curved surface, while a portion for connecting three faces of the front, the side, and the bottom to one another has a spherical surface.

According to this construction, the portion for connecting the front to the side, the portion for connecting the front to the bottom, and the portion for connecting the side to the bottom have a curved surface or a spherical surface. This can avoid local concentration of and can disperse the expansion and the contraction of the sheet member at the time of pressing and thus can prevent a local reduction in wall thickness of the door body or cockling.

Further, in the door device described just above according to the first feature of the invention, preferably, the curved surface of the portion for connecting the bottom to the side has been molded so that the radius of curvature is reduced toward the rear.

According to this construction, since the radius of curvature in the forward direction is large, the expansion and the contraction of the sheet member at the time of pressing can be dispersed. At the same time, since the radius of curvature in the backward direction is small, even though the vending machine body in its corner portion, which, when the door device has been closed, faces the door device, is not formed at a large radius of curvature, there is no sense of incongruity in appearance.

Any one of the above door devices according to the first feature of the invention may have a decoration in a concave/convex form, on the front, produced by pressing.

According to this construction, the provision of a decoration in a concave/convex form on the front of the door body can realize the production of a door body possessing excellent appearance. The formation of the decoration by pressing enables the molding of the decoration simultaneously with the formation of the door body by pressing. This can reduce the production cost.

According to the second feature of the invention, there is provided a door device for opening/closing the front of a vending machine body, said door device comprising an integrally molded structure of a front of the door body and a concave for displaying sample products or the like, produced by pressing of a single sheet of a metal member.

According to this construction, the front of the door body and the concave for displaying sample products or the like are integrally molded by pressing of a single sheet of a metal member. Therefore, the display chamber can be simply assembled. At the same time, the integrally molded display concave functions as a reinforcing member for the door body. Thus, a door device can be realized which has excellent rigidity.

This door device according to the second feature of the invention further comprises a display door that openably covers the display concave from the front and permits the interior of the display concave to be seen through the door.

According to this construction, the display door can prevent the entry of rainwater and the like into the display concave. Further, since the display door can be opened/closed from the front, this facilitates the replacement of sample products and the like displayed within the display concave.

The door device described just above according to the invention has a step which has been produced by pressing between the front and the display concave so that, when the display door has been closed, the step abuts against the rear of the display door and consequently functions as a margin for seal of the display door.

According to this construction, the step as a margin for sealing of the display door is provided between the front and the display concave. This can reduce the level of a projection in the state of closing of the display door.

In the door device described just above according to the second feature of the invention, preferably, a soft sealing member is disposed on at least one of the rear of the display door and the step.

According to this construction, when the display door has been closed, the rear and the step of the display door are sealed by the seal member. This can more fully prevent the entry of rainwater and the like into the display concave.

Any one of the above door devices according to the second feature of the invention may have a decoration in a concave/convex form, on the inner face of the display concave, produced by pressing.

According to this construction, the provision of a decoration in a concave/convex form in the inner surface of the display concave can realize the production of a door body possessing excellent appearance. Further, the formation of the decoration by pressing enables the molding of the decoration simultaneously with the formation of the door body by pressing. This can reduce the production cost.

BRIEF DESCRIPTION OF THE DRAWINGS

The invention will be explained in more detail in conjunction with the appended drawings, wherein:

FIGS. 5A to 5C are diagrams showing the appearance of a door body, wherein FIG. 5A is a front view, FIG. 5B a side view, and FIG. 5C a plan view;

FIGS. 6A and 6B are longitudinal sectional views of the door body shown in FIG. 5A, wherein FIG. 6A is a sectional view taken on line A—A of FIG. 5A and FIG. 6B a sectional view taken on line B—B of FIG. 5A;

DESCRIPTION OF THE PREFERRED EMBODIMENTS

Preferred embodiments of the invention will be explained in detail in conjunction with the accompanying drawings.

At the outset, the construction of a door device 1 will be explained in conjunction with FIGS. 2 and 3. Here FIG. 2 is a perspective view of a vending machine provided with the door device 1 according to the invention, and FIG. 3 a perspective view of a vending machine in such a state that a display door 11*a* is opened.

Figure 2:
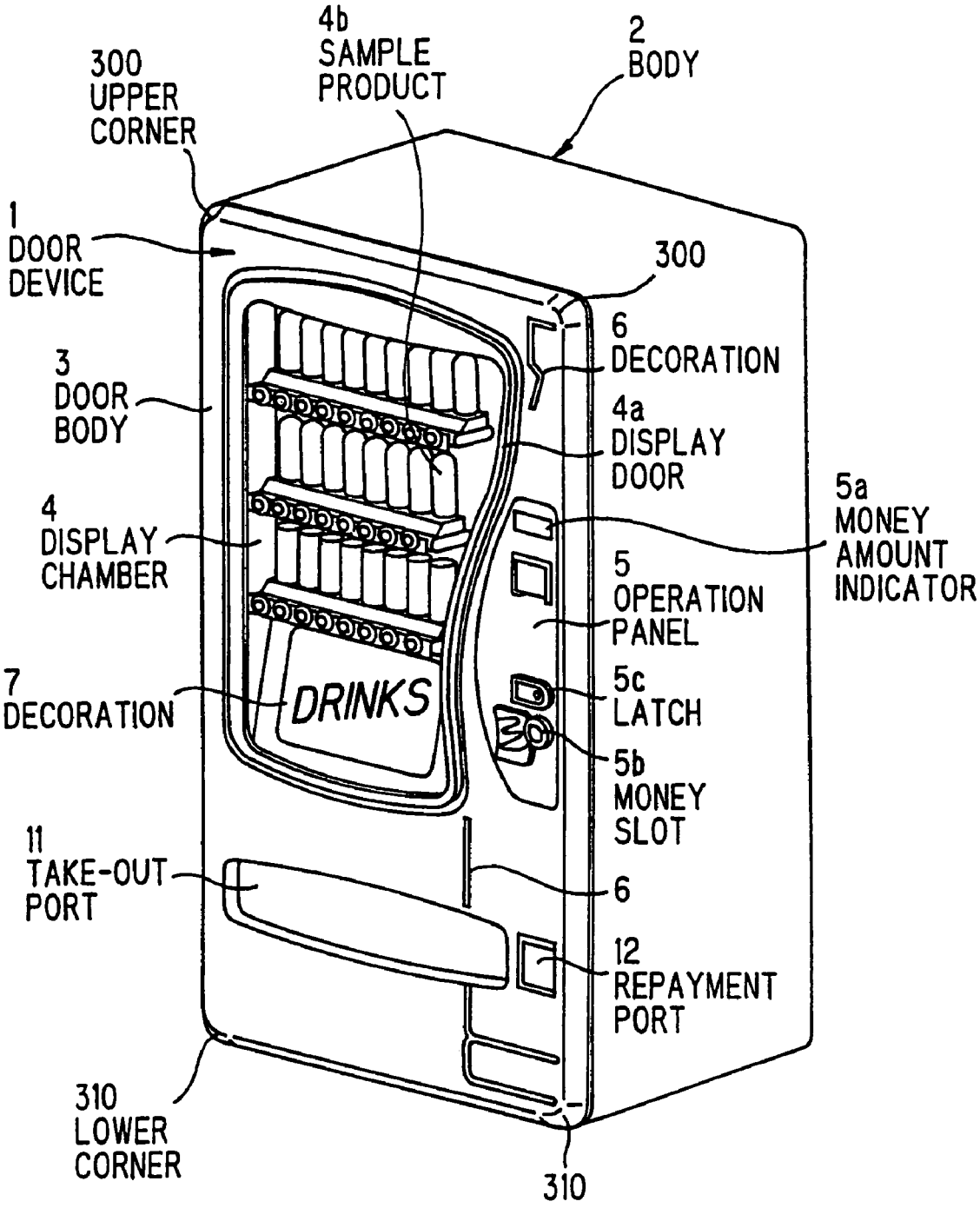
FIG. 2 is a perspective view of a vending machine provided with a door device according to the invention.

As shown in FIG. 2, the door device 1 of the invention comprises: a door body 3 the left end of which is pivotally supported through a hinge (not shown) onto the vending machine body 2; a display chamber provided in the door body 3; an operation panel 5; a take-out port 11 provided at a lower part of the door body 3; and a repayment port 12.

The display chamber 4 comprises a display concave 35 of the door body 3 described below and a display door 4*a* which openably covers from the front the front face of the display concave 35. A plurality of sample products 4*b* are displayed within the display chamber 4. As shown in FIG. 3, this display door 4*a* has a panel 41*a*, formed of a transparent acrylic resin or the like, through which the interior of the display chamber 4 can be seen. The periphery of the display chamber 4 is surrounded by a sash 42*a*. The door body 4*a* in its right end is pivotally supported through a hinge (not shown) onto the door body 3 so that the display chamber 4 can be opened/closed from the front.

The panel 41*a* in the display door 4*a* has a plurality of selection buttons 43*a* for a user to select a desired product that are mounted at respective positions corresponding to sample products 4*b*. On the other hand, a seal member 44*a* formed of a soft material, such as a silicone, is provided in the inner surface of the sash 42*a* so as to surround the periphery of the sash 42*a*. Upon closing of the display door 4*a*, the seal member 44*a* is abutted against a step 37 of the door body 3, and consequently is sandwiched between the step 37 and the sash 42*a* to seal the display chamber 4. Therefore, in such a state that the display door 4*a* is closed, rainwater, dust or the like does not enter the display chamber 4. The seal member 44*a* may be disposed on the step 37 side.

A money amount indicator 5*a*, a money slot 5*b*, a latch 5*c* for opening/closing the door device 1 and the like are provided on an operation panel 5 provided on a side of the display chamber 4.

The take-out port 11 is provided in the door body 3 for taking out a product carried out from the vending machine body 2, and an opening/closing door (not shown) is provided in the opening portion to prevent the entry of rainwater and the like into the take-out port.

The repayment port 12 is provided in the door body 3 in order to take out a change or the like. An opening/closing door is also provided in the opening portion of the repayment port 12 to prevent the entry of rainwater and the like.

Figure 4:
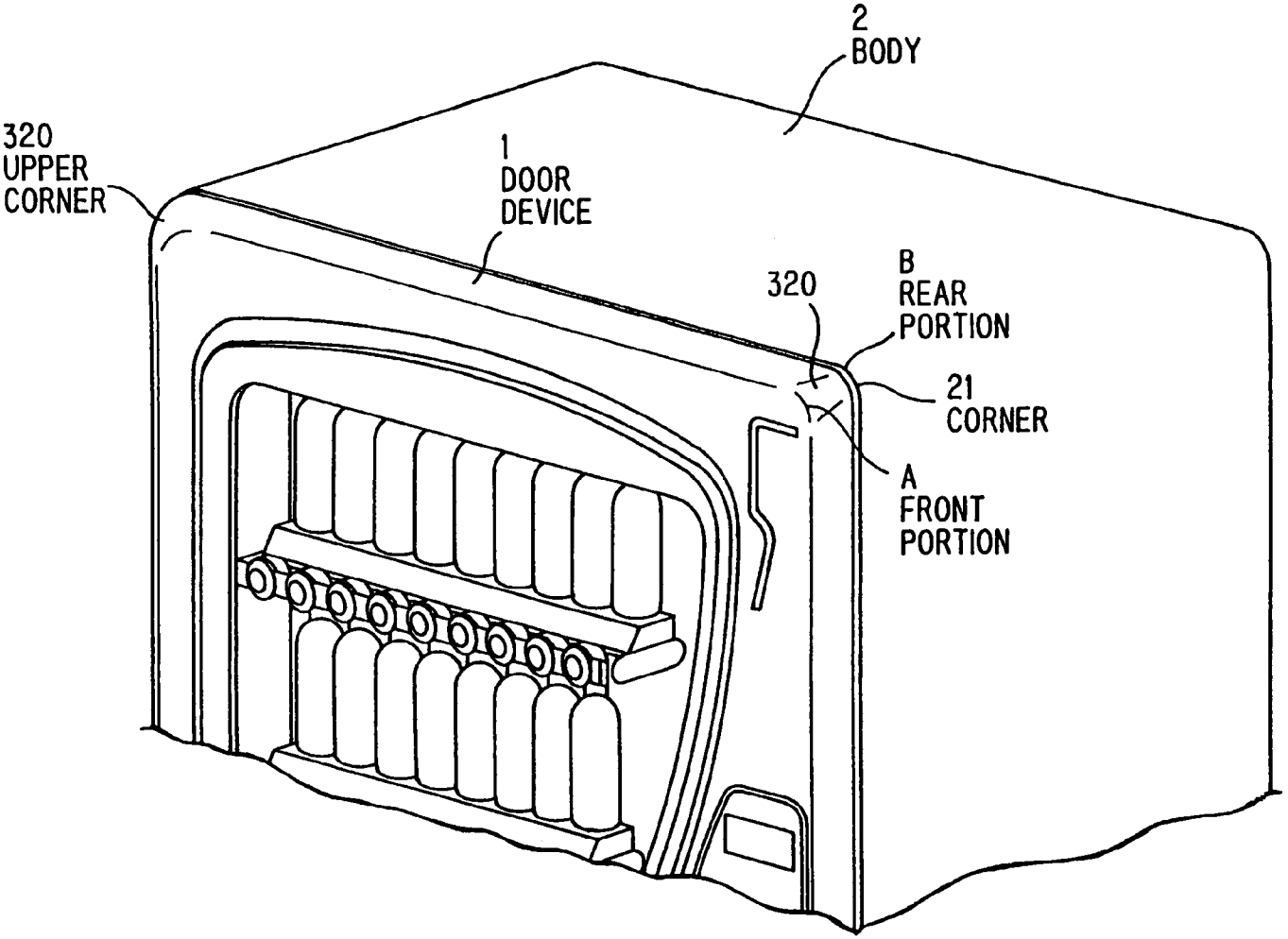
FIG. 4 is an enlarged view of the principal part of FIG. 2.

Next, the door body 3 will be explained in conjunction with FIGS. 4 to 7. FIG. 4 is an enlarged view of the principal part of FIG. 2, FIG. 5 a diagram of the appearance of the door body 3, FIG. 6 a longitudinal sectional view of the door body 3, and FIG. 7 a cross-sectional view of the door body 3.

Figure 6A:
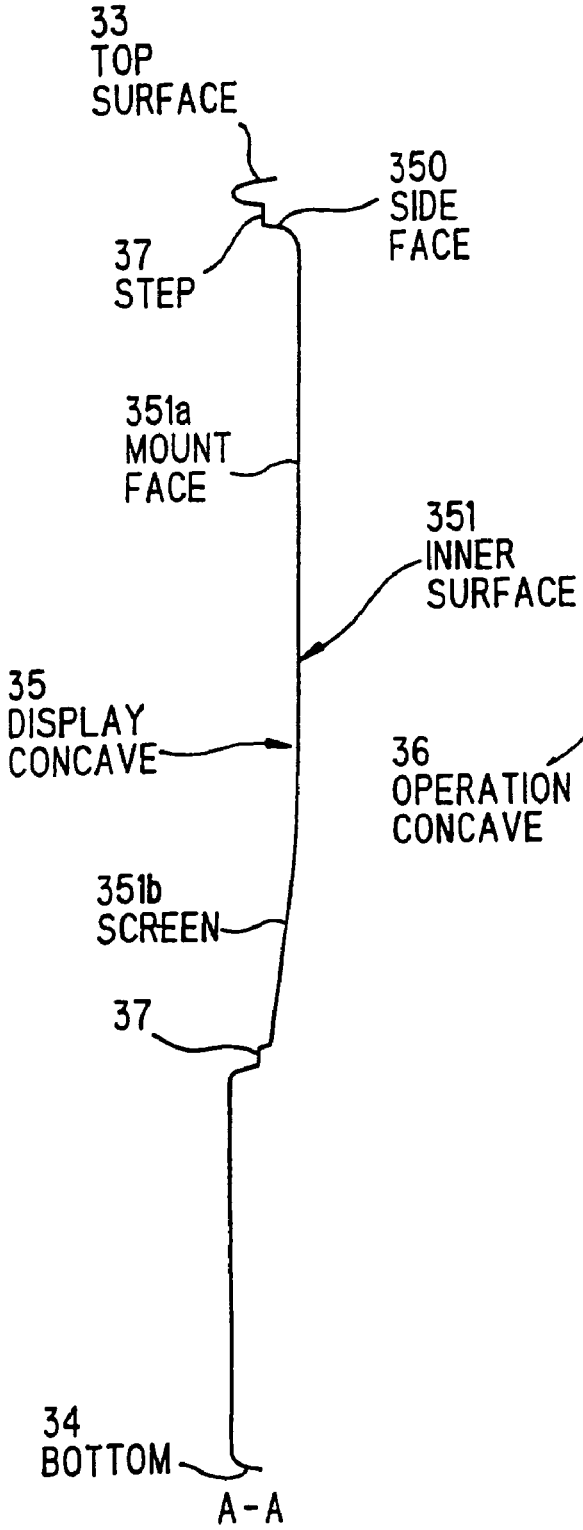
Figure 6B:
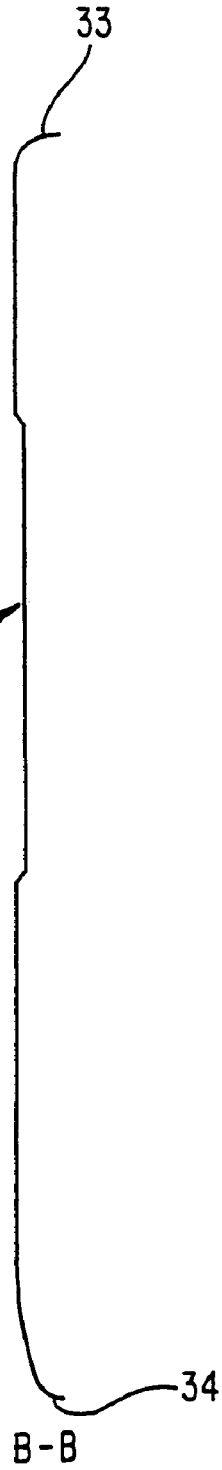
Figure 7:
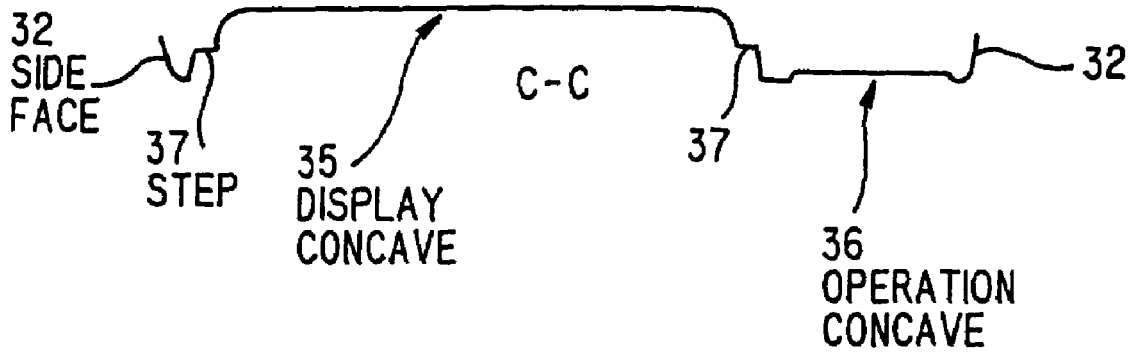
FIG. 7 is a cross-sectional view taken on line C—C of FIG. 5A showing the door body.

The door body 3 comprises a front 31, a side 32, a top 33, and a bottom 34 which, as shown in FIGS. 5 to 7, have been integrally molded without a joint by pressing a single sheet of a metal member.

All corner portions respectively for connection among the front 31, the side 32, the top 33, and the bottom 34 are formed in a curved form (see FIG. 2). An upper corner 300, where three faces of the front 31, the side 32, and the top 33 are connected to one another, and a lower corner 310, where three faces of the front 31, the side 32, and the bottom 34 are connected to one another, are formed in a spherical form.

As shown in FIG. 4, the corner 320 for connecting the top 33 to the side 32 is formed so that the radius of curvature of the front part A is 60 mm (R60) and the radius of curvature of the rear part B is 30 mm (R30). That is, the corner 320 is formed so that the radius of curvature is reduced toward the rear part. In the corner 320 formed in this way, since the radius of curvature in the front part is large, at the time of pressing, local concentration of expansion and contraction of the sheet member can be reduced, and the expansion and contraction force can be dispersed. At the same time, since the radius of curvature in the rear part is small, even though the vending machine body 2 in its corner 21, which, when the door device 1 has been closed, faces the door device, is not formed at a large radius of curvature, there is no sense of incongruity in appearance. Therefore, the shape of the vending machine body 2 in its corner 21, which has hitherto been formed at a right angle, is not required to be changed to a curved shape having a large radius of curvature. This can eliminate the need to significantly change the design of the vending machine body 2.

On the other hand, as with the corner 320, the corner 330 for connecting the bottom 34 to the side 32 is formed so that the radius of curvature of the front part is 60 mm (R60) and the radius of curvature of the rear part is 30 mm (R30). That is, the corner 330 is formed so that the radius of curvature is reduced toward the rear part. Therefore, the same function and effect as in the corner 320 can be provided.

As shown in FIGS. 5 to 7, a display concave 35 for housing therein and displaying sample products 4*b* or the like is formed on the front 31 of the door body 3, and this display concave 35 also has been integrally molded with the door body 3 by pressing.

As shown in FIGS. 6A and 7, this display concave 35 has been molded so as to be concaved in a pot form in section. The side 350 of the display concave 35 is connected to the front 31 through the step 37 serving as a margin for seal of the display door 4*a*. On the other hand, the display concave 35 in its inner surface 351 has a mount face 351*a* for mounting, for example, a sample display base 4*c* (see FIG. 3) and a display face 351*b* which is provided at a lower part of the mount face 351*a* and displays an advertisement and the like. The disposition of a poster or the like on the display face 351*b*, of course, permits an advertisement of products through the display door 4*a* and the transparent panel 41*a* to consumers. Further, pressing of a decoration 7 formed of concaves and convexes on the display face 351*b* can realize an advertisement of products to consumers. For example, as shown in FIGS. 2 and 3, molding of a decoration 6 having a shape of a letter "DRINK" by means of press grooves can realize the provision of a door device 1 having a high level of appeal without disposing a poster and the like.

As shown in FIGS. 6A and 7, the step 37 as the margin for the seal of the display door 4*a* is provided at a position which is inward by one step corresponding to the thickness of the display door 4*a* from the front 31 of the door body 3. The step 37 is provided over the whole periphery of the display door 4*a*. Therefore, when the display door 4*a* is closed, the display door 4*a* is not projected from the front 31 of the door body 3 and thus does not spoil the appearance of the vending machine body.

Further, as shown in FIGS. 6B and 7, an operation concave 36, which is slightly concaved backward, is provided on the front 31 of the door body 3 in its position corresponding to the operation panel 5 on which the money amount indicator 5*a*, the money slot 5*b* and the like are disposed. This operation concave 36 also has been integrally molded with the door body 3 by pressing. The provision of the operation concave 36 can distinguish the operation concave 36 from the other portion and thus can emphasize the position of the operation panel 5 (see FIG. 2) on which the money slot 5*b* and the like are disposed. Therefore, users can more easily operate the vending machine.

Further, a construction may also be adopted wherein a decoration 6 of concaves and convexes can be molded by pressing in a surplus space in the front 31 of the door body 3. For example, as shown in FIGS. 2 and 3, a decoration 6 having a shape of a beverage bottle may also be molded by means of a press groove. This can realize the provision of a door device 1 having a high level of appeal without print decoration and the like.

Next, the pressing of the door body 3 will be explained.

The door body 3 is formed from a single sheet of a flat metal member. At the outset, a flat sheet metal member, which has been cut into a predetermined shape, for example, by an NC device, is provided, and a display concave 35, which requires the deepest drawing, is pressed by a female-male mold for first molding. Next, both the sides 32, the top 33, and the bottom 34 are pressed by a female-male mold for second molding. Finally, press molding, which simultaneously performs molding of the operation concave 36 to be shallowly drawn and finish shaping of details, is performed by a female-male mold for third molding. Thus, the molding of the door body 3 is completed.

In this case, the decoration 7 in the display concave 35 can be formed by pressing simultaneously with the molding of the display concave 35 (first molding). Further, the decoration 6 on the front 31 may be formed by pressing simultaneously with the finish molding (third molding).

According to this preferred embodiment, molding using the three molds for pressing can provide a door body 3 of a vending machine, comprising a deeply drawn portion, such as the display concave 35, shallowly drawn portions, such as decorations 6, 7, the highly curved side 32, and the top 33, that has even thickness and is free from wrinkles.

When the level of concaves and convexes in the drawn portion is low, molding using one or two molds for pressing is also possible. That is, three times of pressing are not limited to molding using three molds for pressing.

Further, instead of using the female-male mold, molding may be carried out, for example, by a hydroform single die molding method wherein only one of upper and lower dies is formed of a fixed material with the other die being formed of a flexible material, such as rubber, and, in molding, even static pressure is externally applied. Pressing is not limited to this preferred embodiment.

Thus, since the door body 3 is molded by pressing using a single sheet of a flat sheet metal member, the faces are integrally molded without any joint. Therefore, unlike the prior art technique, this eliminates the need to perform welding for connecting the faces to each other and in its turn facilitates the work and can realize the production of a door device 1 having excellent appearance and corrosion resistance. Further, the decoration 7 on the display concave 35 and the decoration 6 on the front 31 can be molded simultaneously with other pressing process. This can reduce the cost of decoration in the door device 1. Further, since display concave 35 is integrally molded, the display chamber 4 can be easily assembled, and, in addition, the display concave 35 functions as a reinforcing member of the door body 3. This can enhance the rigidity of the door body. Further, even though the display door 4*a* has been broken for money or product robbery purposes, there is no possibility that the products and proceeds housed within the vending machine are easily robbed, because the display chamber 4 is covered with the display concave 35 which has been molded integrally with the front 31.

Figure 1:
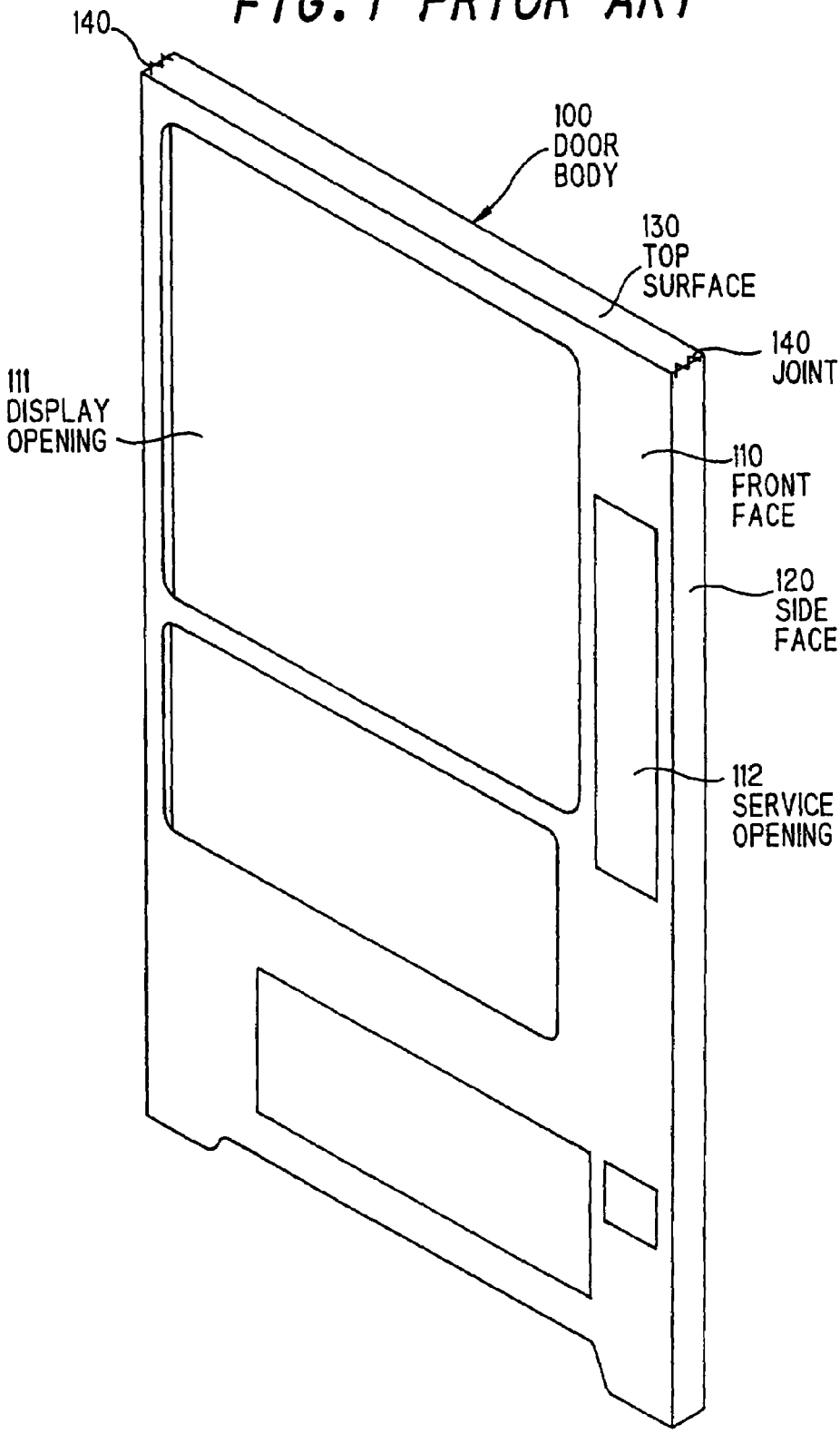
FIG. 1 PRIOR ART
FIG. 1 is a perspective view of a conventional door body.

In the present preferred embodiment, the bottom 34 is integrally molded with the door body 3. Alternatively, as in the conventional door body 100 shown in FIG. 1, no bottom 34 may be provided.

The decorations 6, 7 may be in the form of concaves and convexes that can be molded by pressing. That is, the decoration is not limited to the form of letters and beverage bottles referred to in the above preferred embodiment.

Figure 3:
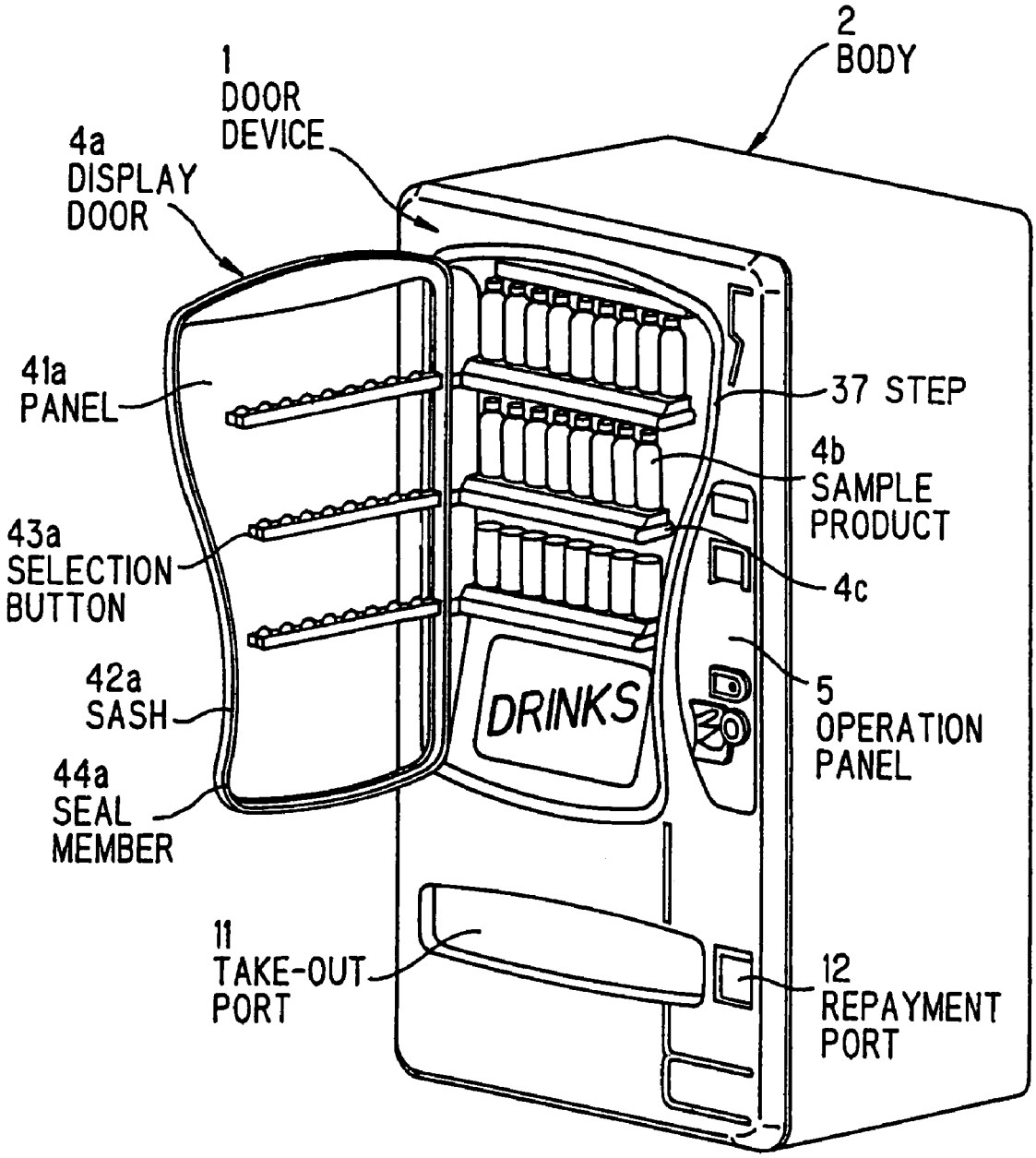
FIG. 3 is a perspective view of a vending machine in such a state that a display door is opened.

In FIGS. 2 to 4, the corners respectively for connection among the front 31, the side 32, the top 33, and the bottom 34, the upper corner 300 for connection of three faces of the front 31, the side 32, and the top 33, and the lower corner 310 for connection of three faces of the front 31, the side 32, and the bottom 34 are indicated by an auxiliary line for showing an image of a curved surface and a spherical surface. In fact, however, as shown in FIG. 5, this auxiliary line does not appear in the curved surface and the spherical surface.

As described above, according to the invention, since the door body is molded by pressing using a single sheet of a flat metal member, there is no joint in each face and the faces are integrally molded with each other. Therefore, unlike the prior art technique, welding for connecting the faces to each other is unnecessary. For this reason, the work is easy, and a door device possessing excellent appearance and corrosion resistance can be produced.

Further, the front of the door body and the concave for displaying sample products or the like are integrally molded by pressing of a single sheet of a metal member. Therefore, the display chamber can be easily assembled. At the same time, the integrally molded display concave functions as a reinforcing member for the door body. Thus, a door device can be realized which has excellent rigidity.

The invention has been described in detail with particular reference to preferred embodiments, but it will be understood that variations and modifications can be effected within the scope of the invention as set forth in the appended claims.

What is claimed is:

1. A method for producing a door device for opening and closing the front of a vending machine body, comprising the steps of:

providing a single sheet of a flat metal member;

pressing the flat metal member to provide a first concave portion for displaying an article; and pressing the flat metal member provided with the first concave portion to provide a front, a side, and a top of a door body, the first concave portion being positioned on the front of the door body, whereby a curved surface of a portion of the door body from the top of the door body to the side of the door body is molded so that the radius of curvature of the curved surface is reduced towards the rear of the door body.

2. The method for producing a door device for opening and closing the front of a vending machine body according to claim 1, further comprising a step of pressing the front of the door body to provide a second concave portion, the first concave portion having a depth greater than that of the second concave portion.

3. A method for producing a door device for opening and closing the front of a vending machine body, comprising the steps of:

providing a single sheet of a flat metal member;

pressing the flat metal member to provide a first concave portion for displaying an article; and pressing the flat metal member provided with the first concave portion to provide a front, sides, a top and a bottom of a door body, the first concave portion being positioned on the front of the door body, whereby a curved surface of a portion of the door body from the top of the door body to the sides of the door body is molded so that the radius of curvature of the curved surface is reduced towards the rear of the door body.

4. The method for producing a door device for opening and closing the front of a vending machine body according to claim 3, further comprising a step of pressing the front of the door body to provide a second concave portion, the first concave portion having a depth greater than that of the second concave portion.

5. A method for producing a door device for opening and closing the front of a vending machine body, comprising the steps of:

providing a single sheet of a flat metal member;

pressing the flat metal member to provide a first concave portion for displaying an article using a first female-male mold for a first molding; and pressing the flat metal member provided with the first concave portion to provide a front, sides, a top and a bottom of a door body using a second female-male mold for a second molding, the first concave portion being positioned on the front of the door body, and pressing the front of the door body to provide a second concave portion using a third female-male mold for third molding, the first concave portion having a depth greater than that of the second concave portion.

* * * * *